US005404823A

United States Patent [19]

Abegglen et al.

[11] Patent Number: 5,404,823

[45] Date of Patent: Apr. 11, 1995

[54] EMBROIDERY MACHINE INCLUDING A CONTROL ELEMENT AT EACH EMBROIDERY LOCATION

[75] Inventors: Hans Abegglen, Arbon; Jürg Henz, Amriswil, both of Switzerland; Manfred Zesch, Fussach, Austria

[73] Assignee: Saurer Sticksysteme AG, Arbon, Switzerland

[21] Appl. No.: 111,135

[22] Filed: Aug. 24, 1993

[30] Foreign Application Priority Data

Jul. 10, 1993 [EP] European Pat. Off. ..... 93111062

[51] Int. Cl.[6] ..... D05C 5/02

[52] U.S. Cl. ..... 112/84

[58] Field of Search ..... 112/78, 80.43, 80.44, 112/80.45, 83, 84, 85, 87, 89, 28

[56] References Cited

U.S. PATENT DOCUMENTS

| | | | |
|---|---|---|---|
| 1,162,009 | 11/1915 | Zahn | 112/83 |
| 4,366,767 | 1/1983 | Teetz et al. | 112/98 |
| 4,434,728 | 3/1984 | Comploi et al. | 112/221 X |
| 4,535,709 | 8/1985 | Kühnis et al. | 112/83 |
| 4,543,897 | 10/1985 | Heinzle | 112/98 X |
| 4,580,511 | 4/1986 | Comploi et al. | 112/84 |
| 4,594,952 | 6/1986 | Comploi et al. | 112/84 |

FOREIGN PATENT DOCUMENTS

| | | | |
|---|---|---|---|
| 2900804 | 7/1980 | Germany | 112/98 |
| 4-041763 | 2/1992 | Japan | 112/98 |
| 651081 | 8/1985 | Switzerland . | |
| 660892 | 5/1987 | Switzerland . | |

*Primary Examiner*—Clifford D. Crowder
*Assistant Examiner*—Ismael Izaguirre
*Attorney, Agent, or Firm*—Keck, Mahin & Cate

[57] ABSTRACT

Embroidery machine including several hundred embroidery locations each of which includes the following tools; a needle, a stiletto, a thread guide and a thread brake with respective drives. At least two actuators for connecting or disconnecting the tools from their respective drives are associated with every embroidery location. No more than one switching element, such as a shuttle spool valve is provided for each embroidery location which is switchable so as to switch all the actuators of said embroidery location jointly. Such a switching arrangement permits efficient switching of the tools enabling selective switching of only the tools of a switching point the embroidering/non-embroidering state of which is to be changed.

4 Claims, 5 Drawing Sheets

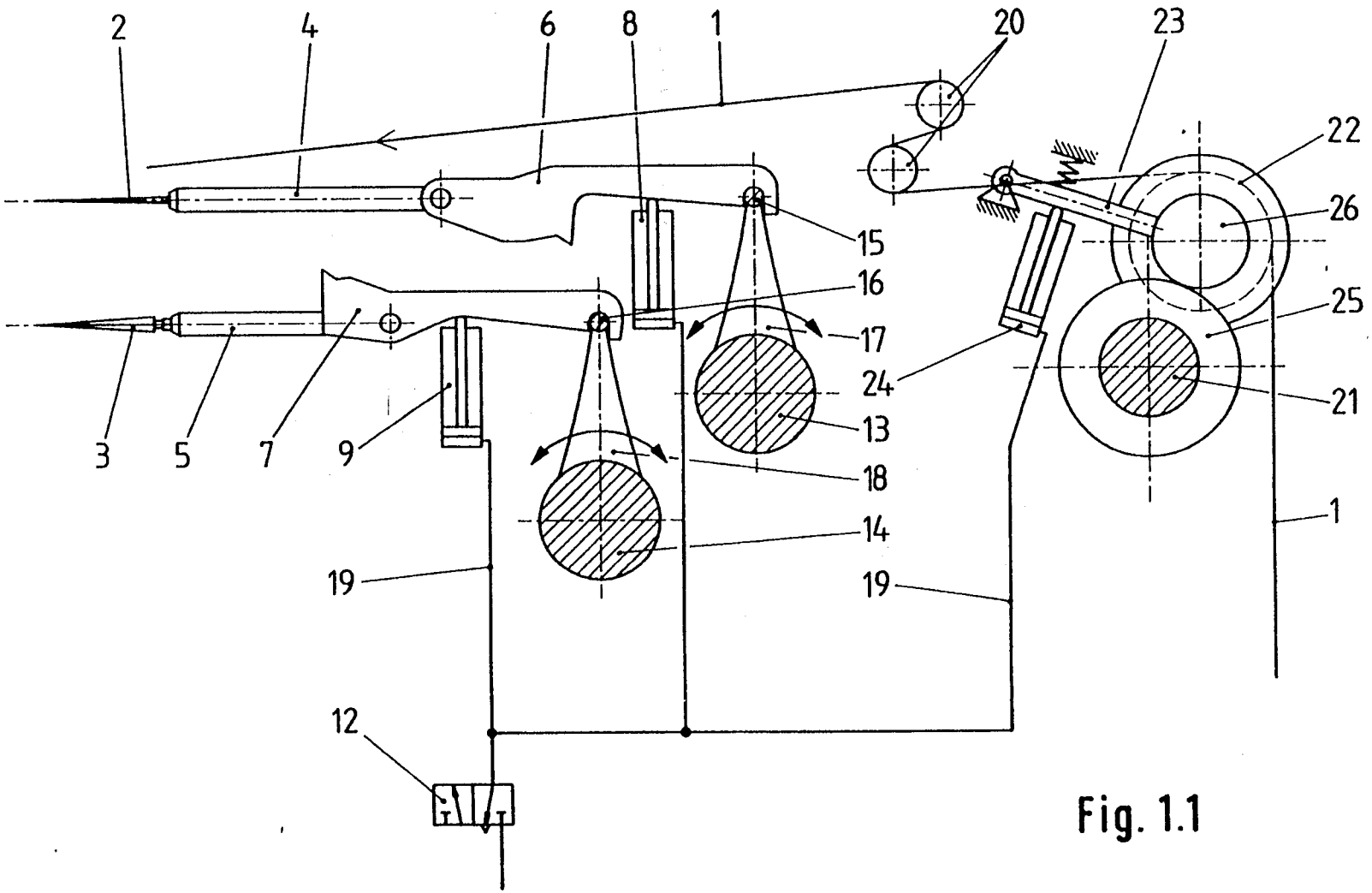
Fig. 1.1

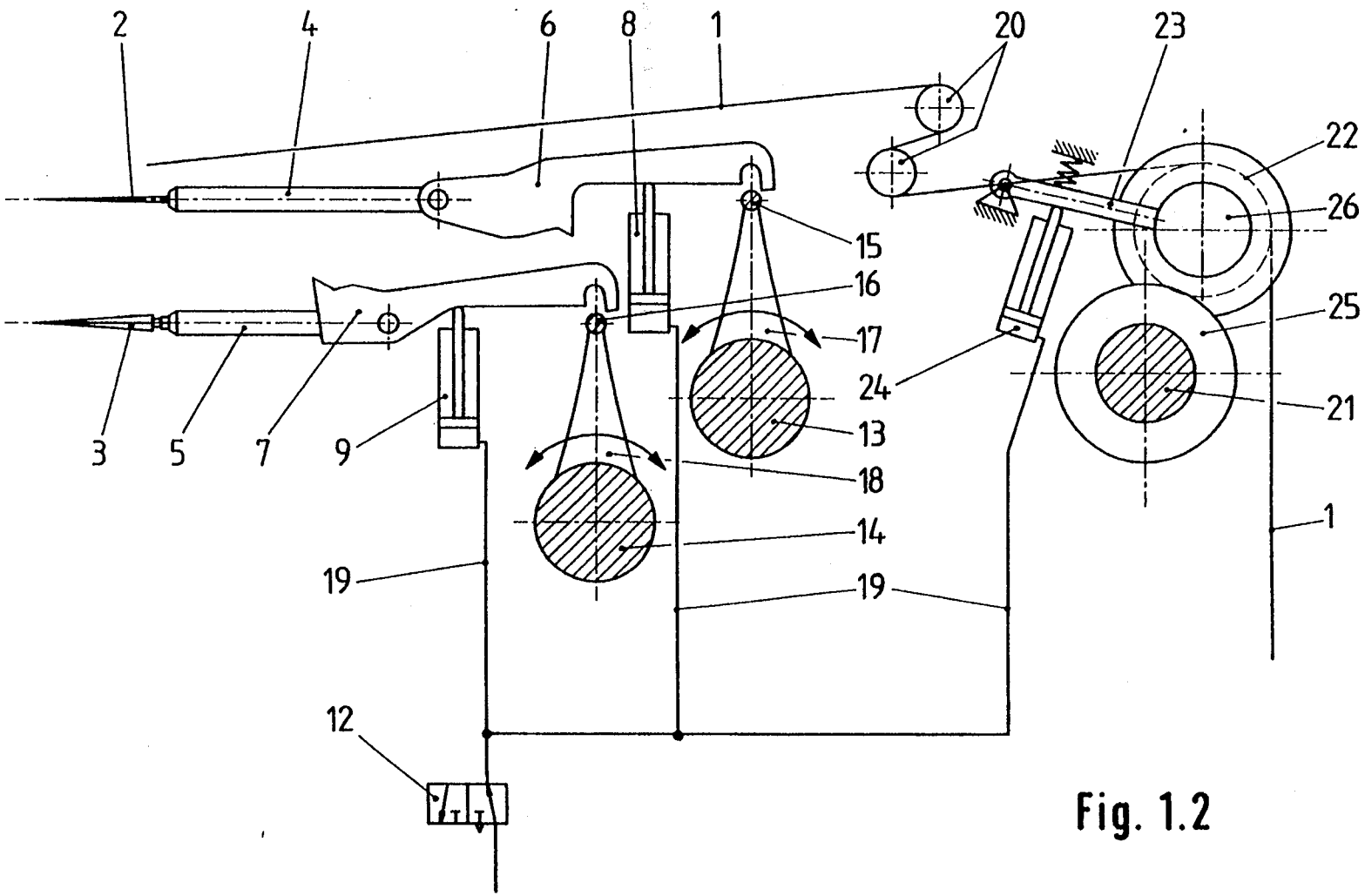
Fig. 1.2

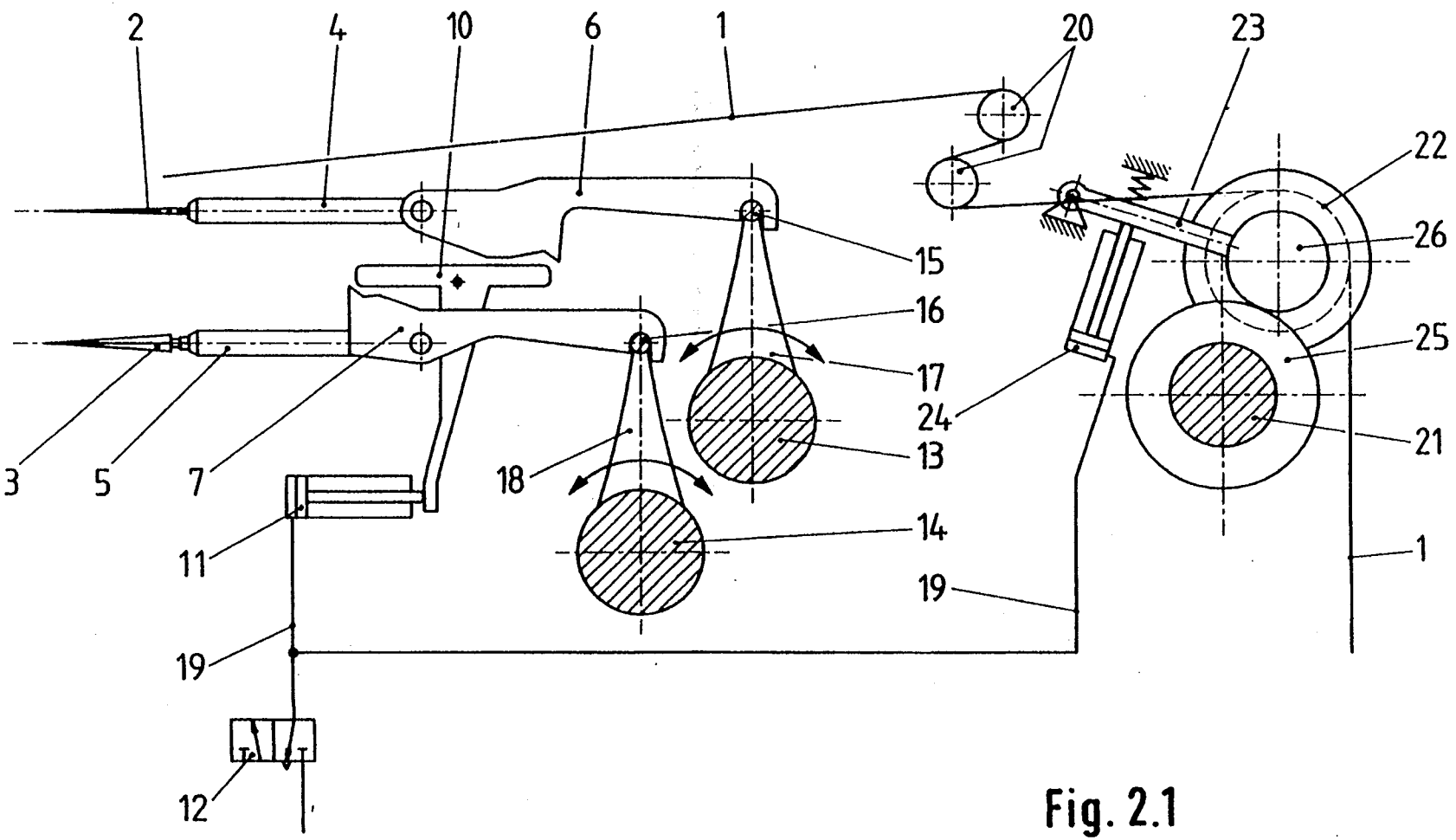
Fig. 2.1

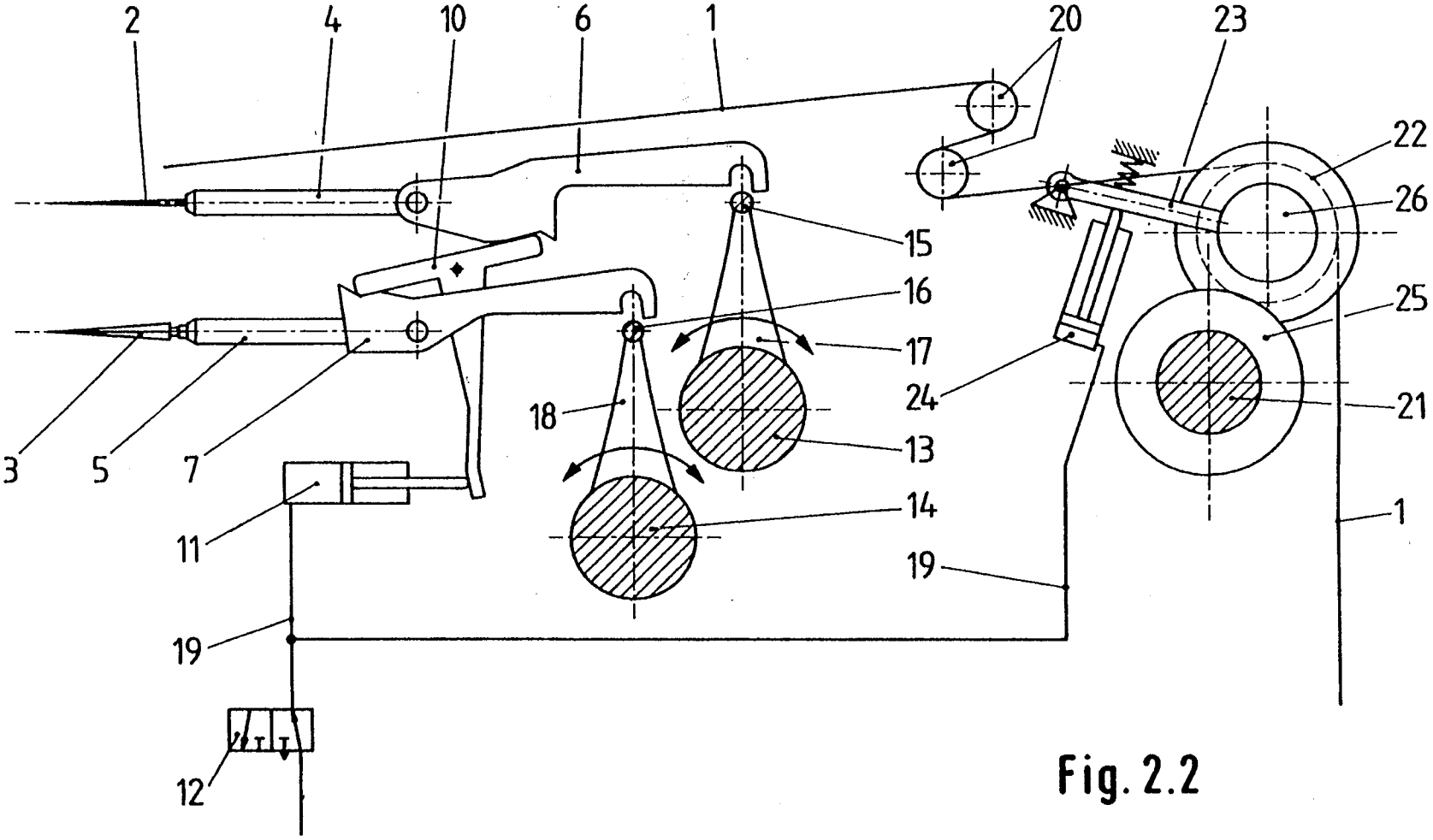
Fig. 2.2

| | | | | | | | | | | | | |
|---|---|---|---|---|---|---|---|---|---|---|---|---|
| A | 1 | 2 | 3 | 4 | 5 | 6 | 7 | 8 | 9 | 10 | 11 | 12 |
| B | X | 0 | 0 | X | 0 | 0 | X | 0 | 0 | X | 0 | 0 |
| C | X | 0 | X | 0 | X | 0 | X | 0 | X | 0 | X | 0 |
| D | | | | 0 | | | | | | 0 | | |
| E | | | X | | X | | | | X | | X | |

Fig. 3

EMBROIDERY MACHINE INCLUDING A CONTROL ELEMENT AT EACH EMBROIDERY LOCATION

FIELD OF THE INVENTION

The present invention relates to large embroidery machines with many embroidery locations at each of which tools such as a needle and a borer are selectively couplable to drives depending on whether stitching is to be performed at that particular embroidery location.

BACKGROUND ART

Large embroidery machines normally equipped with a few hundred embroidery locations which are arranged in one or more rows at equal intervals (embroidery location repeat). At each embroidery location, additional corresponding tools are associated with a needle (shuttle, borer, thread guide, thread supply, etc.). Operation with different embroidery location repeats (e.g. every second, third, etc. embroidery location), with differently colored yarns, or embroidery of any arrangement of patterns requires that certain embroidery locations are in use, but other embroidery locations are not working. For switching to different combinations of working and non-working embroidery locations, so-called color and repeat changing apparatuses have been developed.

Swiss patent 660 892 (Heinzle) shows a solution for switching the needles and borers between an embroidering and a non-embroidering state. The needles and borers are driven by a single shaft. This solution has the great disadvantage that every time there is a switch from embroidery to piercing and from piercing to embroidery, all the needles or borers must be uncoupled and all the borers or needles being used must be coupled. This connection of all needle couplings or borer couplings is repeated twice in each piercing process, even if work is being continued in the same repeat or in the same combination of embroidery locations. The result is, a large number of connections of all embroidery locations, particularly with pierced work. This results in a corresponding waste of time and energy.

By contrast, Swiss patent 651 081 (Comploi) shows a solution in which each needle and borer of all embroidery locations are driven by a separate shaft. With a single actuator per embroidery location, not only needle and borer, but also other tools of the embroidery location (thread supply, thread stop motion, etc.) are coupled. On switching from embroidery to piercing and vice versa, only the corresponding drive shaft is driven or stopped. Coupling or uncoupling of the tools of different embroidery locations takes place only on changing the combination of operative and inoperative embroidery locations. This solution requires a powerful actuator with corresponding power consumption, or power assist. As the tools of an embroidery location must be arranged separately, the solution with only one actuator (per embroidery location) requires corresponding mechanical connecting elements for coupling-/uncoupling the different tools or restrictions in the arrangement of the tools.

In the above-mentioned previous solutions, when changing to a new combination of embroidering or non-embroidering embroidery locations, in each case all the embroidery locations must be brought to a basic state (e.g. all ON or all OFF), before a new combination can be switched. In the solution according to Swiss patent 660 892, all the needles or all the borers must be disconnected even with every switch from embroidery to piercing or piercing to embroidery.

OBJECTS OF THE INVENTION

It is an aim of the invention to retain the advantage of the small number of switching operations by providing a separate drive for each of the different tools (needle, borer), but to eliminate complex mechanical switching transmissions, and gain complete freedom in the arrangement of tools.

SUMMARY OF THE INVENTION

The foregoing objects of the invention are achieved by provision of an embroidery machine in which associated with every embroidery location there are several actuators (magnets, pneumatic cylinders, hydraulic cylinders) which are all simultaneously brought into one of two end positions with only one switching element per embroidery location. These individual actuators can be arranged in each case directly by the tool to be switched, which on the one hand yields complete freedom in arrangement of the tools, and on the other hand allows the use of low-power actuators. The connections from the common switching element to the individual actuators (cables, hoses, etc.) can easily be made without expenditure. The actuators preferably have two fixed end positions into which they can be selectively moved and held. Hence there is an unambiguous state (coupled or uncoupled) for all tools of an embroidery location.

In the embroidery machine according to the invention with one switching element per embroidery location and actuators with two end positions between which the actuator can be selectively moved and held, all the embroidery locations no longer need first to be brought into a basic position in order then to select the new combination. The embroidery locations which are already switched to the correct state can be determined in advance by electronic means. The embroidery locations which have to be brought into the ON or OFF position in order to obtain the next combination of embroidery locations can be similarly determined. Due to this solution, the expenditure on switching is substantially reduced.

BRIEF DESCRIPTION OF THE DRAWINGS

A detailed description of two embodiments of the invention follows which refers to the accompanying figures in which:

FIG. 1.1 shows a schematic view of an embroidery location of a machine constructed according to the invention with the embroidery location switched on (tools connected to their respective drives), FIG. 1.2 shows a similar view to FIG. 1.1 with the embroidery location switched off, FIG. 2.1 shows a schematic view of an embroidery location similar to FIG. 1, wherein however one actuator operates two tools which are switched on, FIG. 2.2 shows a similar view to FIG. 2.1 with the embroidery location switched off, FIG. 3 shows a schematic view of combinations of embroidery locations for determining switching commands.

DETAILED DESCRIPTION OF THE INVENTION

In FIG. 1 is shown schematically an embroidery location with a switching system constructed according to the invention. The needle 2 and borer 3 are held in the needle carrier 4 and borer carrier 5 respectively and guided for axial movement. By means of the needle actuating member 6 and borer actuating member 7 they can be coupled to and uncoupled from the tubular needle driving member 15 and the tubular Stiletto driving member 16 respectively. FIG. 1.1 shows the actuating members in the coupled state and FIG. 1.2 shows them in the uncoupled state. The driving members 15 and 16 are rigidly connected by carriers 17 and 18 to the corresponding drive shafts 13 and 14. In the coupled state, the oscillating movement of the drive shafts 13 and 14 is converted to a linear movement of the corresponding tools 2 and 3. By operation of the actuators 8 and 9 the actuating members 6 and 7 are lifted and hence uncoupled from their driving members 15 and 16. In this state the tools of this embroidery location remain inoperative, although the oscillating drive shafts run across all the embroidery locations and forms a common drive for all the embroidery locations.

The embroidery yarn 1 is guided over a thread supply roller 22 and over the thread guides 20 to the needle 2. By pinion 26 and gear 25, the thread supply roller 22 is coupled to the thread supply shaft 21 which passes through across all the embroidery locations. The thread supply shaft 21 can be driven or supplied centrally, in order thus to regulate the thread tension and thread supply. The thread supply roller 22 is mounted on the one-armed thread supply lever 23. In FIG. 1.1 the thread supply roller 22 is coupled to the thread supply shaft 21. By operation of the actuator 24, the thread supply lever 23 is lifted and so the pinion 26 and gear 25 are disengaged, whence the thread supply roller 22 is uncoupled from the thread supply shaft 21.

Similarly, further tools of an embroidery location (e.g. thread stop motion, pressure foot, thread guide, etc.) can be actuated or deactuated, or coupled to or uncoupled from their respective drives, by further actuators. For every embroidery location there is provided a switching element 12 which is connected to the actuators 8, 9, 24 by corresponding connections 19 (electric cables, pneumatic or hydraulic hoses, etc.). With one switch of the switching element 12, therefore, all the actuators 8, 9, 24 of this embroidery location are operated simultaneously and so as to have the same coupling or uncoupling effect i.e. the embroidery location is switched on or off as a whole. The connections 19 may be arranged very flexibly, so that in the arrangement of tools in an embroidery location no allowance has to be made for common switching. But it may follow from any boundary conditions that two or more tools of an embroidery location are arranged very close to each other. If advantages arise from this, two or more tools can then be operated jointly with a common actuator 11 via a coupling member 10, see FIGS. 2.1, 2.2. By using actuators which are held selectively in one of two end positions, each embroidery location can be brought into the switched on or off state by a single signal to the switching element 12. It is therefore no longer necessary, as in the prior art arrangements, to reset all the embroidery locations or their coupling members to a basic state before switching to a new combination, in order only then to connect a new combination of embroidery locations which are switched on and off.

FIG. 3 shows schematically how, as a result, of the switching arrangement the switching frequency is reduced and hence time and energy are saved. Line A is the beginning of the linearly arranged embroidery locations numbered from 1 onwards. Depending on the length of the machine, the number is about 100 to 700 embroidery locations. Line B shows a given repeat switching arrangement, in this case a repeat of three (in embroidery terminology a 12/4 repeat), wherein of three needles it is always only the first one at any given time that embroiders.

If there is now a switch from stitch combination B to stitch combination C, with all the previous embroidery location switching systems all the embroidery locations had to be reset to a basic position (ON or OFF). Only then could the new combination (e.g. C) be established. With the solution according to the invention with actuators with fixed end positions, first in a simple programme, by comparing combination B and combination C, it is established which embroidery locations can remain in their switched state (e.g. embroidery locations nos. 1, 2, 6, 7, 8, 12, etc.), and which must be switched on (nos. 3, 5, 9, 11) or off (4, 10). This procedure provides a much shorter switching time to another combination of embroidery locations. At the same time the number of switches and hence also the necessary switching energy are substantially reduced.

In the above description the terms "switching element" and "actuator" are taken to have the following meaning:

By "switching element" is meant just a switching member not having a direct dynamic effect, on a tool being controlled e.g. operating elements which are used to switch and control a stream of material or energy, e.g. hydraulic or pneumatic multiple-way valves, electric switches and the like.

By "actuator" is meant a force-applying control element, e.g. a hydraulic or pneumatic cylinder, an electromagnet or electric motor, the membrane of an expansion element and the like.

With this description of the invention in detail those skilled in the art will appreciate that modifications may be made to the invention without departing from the spirit thereof. Therefore it is not intended that the scope of the invention be limited to the specific embodiments that have been illustrated and described. Rather, it is intended that the scope of the invention be determined by the scope of the appended claims.

We claim:

1. An embroidery machine comprising:

a plurality of embroidery locations in at least one row at equally spaced intervals, the following tools being provided at each embroidery location: a needle, a borer, a thread guide and a thread supply for supplying thread to the needle, driving means for driving said tools, a coupling for each of said tools for connecting or disconnecting each or all of said tools to or from their respective said driving means, at each embroidery location at least two force applying active elements selected from the group consisting of hydraulic cylinders, pneumatic cylinders, electromagnets, electric motors and membranes of expansion elements, for operating upon said couplings, at each embroidery location only one control element selected from the group consisting of a hydraulic valve, a pneumatic valve and an electrical switch, for controlling the flow of energy to the force applying elements, and said one control element supplying all the force applying elements with energy and actuating all the force applying elements jointly.

2. An embroidery machine according to claim 1, wherein the force applying elements are selectively held in one of two end positions.

3. An embroidery machine according to claim 1, wherein while switching the embroidery machine from a first combination of engaged and not engaged embroidery locations to a second combination of engaged and not engaged embroidery locations only the control elements of embroidery locations which change their state from working to inactive or vice versa are actuated.

4. An embroidery machine according to claim 1, wherein tools each having couplings to connect or disconnect each said tool to or from its respective drive which are close together, are operated by only one force applying element.

5. An embroidery machine according to claim 1 wherein all said needles are drivable by a first oscillatable shaft and all said borers are drivable by a separate oscillatable second shaft, each said shaft having a driving member rigidly connected thereto and extending parallel thereto and wherein needles and borers are selectively couplable by actuating members to a corresponding driving member.

6. An embroidery machine according to claim 5 wherein each driving member comprises a tube which is rotatable about its longitudinal axis and connected to its respective shaft by means of a carrier.

* * * * *